US007210529B2

(12) United States Patent
Ruttley

(10) Patent No.: US 7,210,529 B2
(45) Date of Patent: May 1, 2007

(54) CASING BRUSH TOOL

(75) Inventor: David J. Ruttley, Marrero, LA (US)

(73) Assignee: Rattler Tools, Inc., Harvey, LA (US)

( * ) Notice: Subject to any disclaimer, the term of this patent is extended or adjusted under 35 U.S.C. 154(b) by 137 days.

(21) Appl. No.: 10/965,532

(22) Filed: Oct. 14, 2004

(65) Prior Publication Data

US 2006/0081375 A1 Apr. 20, 2006

(51) Int. Cl.
*E21B 21/00* (2006.01)

(52) U.S. Cl. ..... 166/311; 166/173; 166/176

(58) Field of Classification Search ..... 166/311, 166/170, 173, 176
See application file for complete search history.

(56) References Cited

U.S. PATENT DOCUMENTS 1,855,046 A * 4/1932 Gerhardt ..... 15/104.2
2,072,110 A * 3/1937 Jennings ..... 300/21
2,215,514 A * 9/1940 MacGregor ..... 166/170
6,460,617 B1 * 10/2002 Allen ..... 166/173
6,851,472 B2 * 2/2005 Hern et al. ..... 166/173
2001/0040035 A1 * 11/2001 Appleton et al. ..... 166/387
2001/0042623 A1 * 11/2001 Reynolds ..... 166/312
2005/0205251 A1 * 9/2005 Tulloch et al. ..... 166/173

* cited by examiner

*Primary Examiner*—William Neuder
(74) *Attorney, Agent, or Firm*—Keaty Professional Law Corporation

(57) ABSTRACT

A casing brush tool for cleaning interior walls of a well bore casing. The brush tool has a free rotating sleeve mounted on a mandrel with bearings mounted between the sleeve and the mandrel to facilitate rotation. The sleeve carries a plurality of non-axial rows of bristles that are arranged to wind in a spiral, or helical fashion from one end of the sleeve to the other end. When moved in and out of the casing, the spiral rows of bristles cause rotation of the sleeve and by contacting the walls of the casing, clean the casing of the extraneous matter. A casing brush assembly may incorporate one or more of the brush tools. If more than one brush tool is used, it is preferred to use the sleeves having opposite direction of bristle rows such that the sleeves rotate in opposite directions when lowered into the well bore or retrieved from the casing.

6 Claims, 2 Drawing Sheets

CASING BRUSH TOOL

BACKGROUND OF THE INVENTION

The present invention relates to a casing brush for use in oil and gas wells.

When the work is conducted on a well casing the tubular casing members are stacked end-to-end and lowered into the well bore. New casing segments often have imperfections on the interior surfaces of the tubulars; old casing segments often have accumulated debris that clings to the inner walls. When production devices are run through the casings they scrape the sides of the casing and cause the debris that is on the casing to pile up downhole, which can eventually jam up the lowermost casing segment. With older pipes, the problem is also of a significant buildup of ferrous debris, such as bits and pieces of metal generated during drilling of a well. While some of the metal debris can be retrieved with magnetic retrieval tools, other obstructing pieces may not be removed from the interior walls of the casing to allow smooth operation of the downhole tools.

Conventionally, the interior of the casing can be cleaned with a scraper, which literally scrapes the walls of the casing to dislodge residue adhering to the walls or with brushes, which have flexible bristles that contact the walls of the casing and brush off the undesirable debris. Some of the brushes have bristles secured on the outer faces of cylindrical bodies and arranged in parallel axial vertical or horizontal rows. Some of the known devices use outwardly biased bristle members mounted on a cylindrical mandrel, with internal springs forcing the bristles to come into contact with the interior wall of the casing. The brush tools are usually pushed inside the casing, applying vertical force to the debris without rotating the brush in the casing.

However, conventional brushes tend to leave some of the debris on the surface. Particularly troublesome is the area of attachment of two casing segments, which are usually secured by exterior collars. The line of connection between the two casing segments tends to accumulate bits of extraneous material in the crevices formed at the joint line. These areas are more difficult to dislodge without several trips downhole.

The present invention contemplates elimination of drawbacks associated with the prior art and provision of an improved casing brush tool, which can be incorporated into a drill string and run downhole for cleaning the interior of the casing and substantially reducing the time required for cleaning the well casings.

SUMMARY OF THE INVENTION

It is, therefore, an object of the present invention to provide a well casing brush for use in oil and gas well bores.

It is another object of the present invention to provide a casing brush tool, which is easy to operate and inexpensive to manufacture.

It is a further object of the present invention to provide a brush assembly, which rotates while being inserted into the casing to facilitate cleaning of the casing walls.

These and other objects of the present invention are achieved through a provision of a casing brush tool, which has a free rotating sleeve mounted on an elongated mandrel. The sleeve carries a plurality of non-axial rows of bristles that are adapted to contacting the walls of the casing and dislodging the debris from the walls. The non-axial rows wind up, in a spiral or helical path, about the sleeve, substantially from one end of the sleeve to the other end of the sleeve. To facilitate rotation of the sleeve about the mandrel, a pair of bearing devices is mounted between the mandrel and the sleeve, one bearing device at the upper end of the sleeve, and one bearing device—adjacent a lower end of the sleeve.

The casing brush assembly may contain on or more of the brush tolls. If two of the brush tools are incorporated into the assembly, they may be connected end-to-end. In such a case, it is preferred that the bristle rows extend in helical rows of opposite directions. When lowered into the casing, the bristles of the first brush tool will cause rotation of the sleeve in one direction, for instance clockwise direction, while the bristles of the second brush tool will cause rotation of the second sleeve in the opposite, counterclockwise direction. As a result, the casing walls are "swept" by rotating bristles that are pushed down hole or removed from the down hole, thereby providing both vertical and rotational force on the bristles and facilitating a cleaning action of the casing inner walls.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 1:
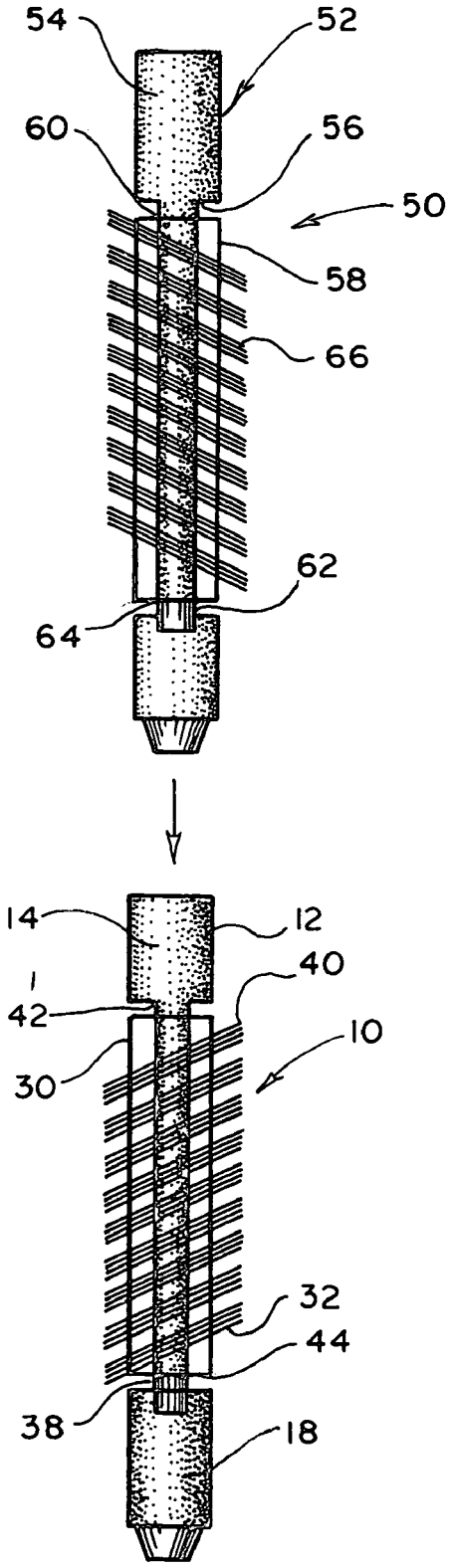
FIG. 1 is a perspective view of the brush assembly in accordance with the present invention, with two brush tools incorporated in the assembly.
Figure 2:
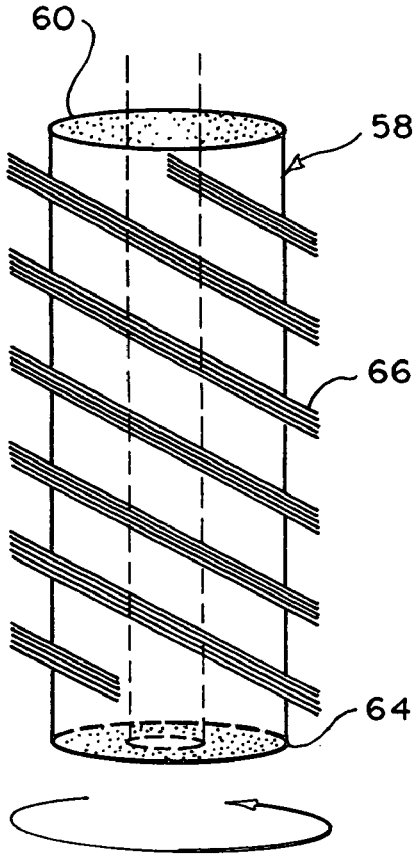
FIG. 2 is a perspective view of a sleeve having bristles particularly adapted for left hand or counter-clockwise rotation.
Figure 3:
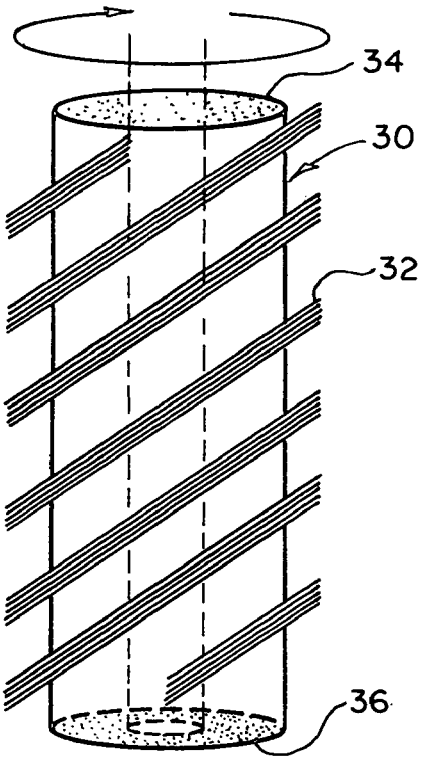
FIG. 3 is a perspective view of a sleeve particularly adapted for right hand or clockwise rotation.
Figure 4:
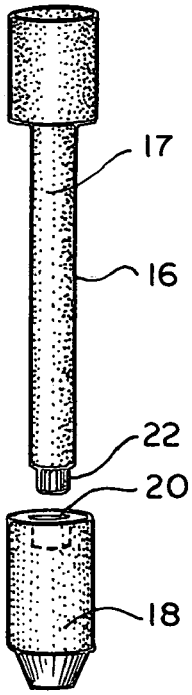
FIG. 4 is a perspective detail view of the brush tool mandrel.
Figure 5:
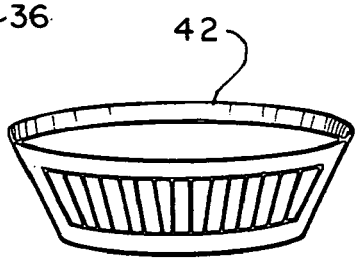
FIG. 5 is a perspective detail view of the upper bearing used in the tool of the present invention.
Figure 6:
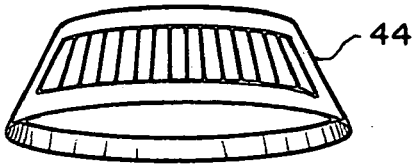
FIG. 6 is a perspective view of the lower bearing of the brush tool in accordance with the present invention.

Turning now to the drawings in more detail, numeral 10 designates a brush tool comprising a brush tool body 12 having an upper connector member 14 and a mandrel 16. A tool joint sub 18 is detachably secured on the lower end of the mandrel 16 by threaded engagement of connector member 20 with inner threaded joint 22 of the sub 18. When assembled, the lower end of the mandrel 16 with exterior threads 22, extends into the opening of the sub tool joint 18 provided with interior threads 20. The mandrel 16 has an upper portion, which forms a tool joint 54, and a reduced diameter portion 17.

Mounted in a free rotational and in a surrounding relationship about the reduced diameter portion 17 is a hollow cylindrical sleeve 30. The hollow cylindrical sleeve 30 has an interior diameter, which is slightly greater than the diameter of the reduced diameter portion 17 of the mandrel 16. The sleeve 30 carries a plurality of rows of bristles 32. The bristles 32 are secured on the exterior surface of the sleeve 30 and are arranged in non-axial rows, in spiral or helical rows extending from about the top 34 of the sleeve 30 to about the bottom 36 thereof.

It is envisioned that in the preferred embodiment, the bristles are secured in a helical path of constant pitch and diameter from the top end 34 to the lower end 36 of the sleeve 30. The bristles 32 of the tool 12 are arranged in a right hand spiral or helical path. When lowered into the wellbore, the lowermost edge 38 of the bristles 32 first contacts the inner wall of the casing, with the remainder of the bristles following after the leading edge 38. The downward force exerted on the tool body 12 causes rotation of the sleeve 30, thus causing the bristles 32 to scrape against the inner surface of the casing and dislodge the settled particles, thereby cleaning the casing. When the tool body 12 is withdrawn from the wellbore, a leading edge 40 of the upper spiral segment becomes the first leading edge, helping to remove the dislodged particles from the wellbore.

The spiral winding of the bristles 32 about the sleeve 30 forms a more durable brush as compared with conventional brushes wherein the bristles extend radially from the tool body. In the conventional design, the bristles are subject to more wear because they contact the walls of the casing transversely to the force exerted on the brush pushed into the casing. In the design of the present invention, where the bristles arranged in a winding, spiral fashion, the angle of force is changed, exerting less wear on the bristles 32.

To facilitate rotation of the sleeve 30 about the reduced diameter portion 16, a top bearing assembly 42 and a lower bearing assembly 44 are secured the upper end 34 and below the lower end 36 of the sleeve 30 between the sleeve 30 and the mandrel portion 17.

The casing brush assembly may contain one or more of the brush tools. As shown in FIG. 1, two of such brush tools may be incorporated into one brush assembly. A left hand rotating brush tool 50 can be connected end-to-end to the first brush tool 10. The second brush tool 50 is similar in many respects to the first casing brush tool 10. The tool brush 50 has a brush body 52, which is provided with an upper tool joint 54 adapted for engagement with string subs (not shown) when the tool is run into the wellbore. A reduced diameter mandrel portion 56 extends downwardly from the tool joint portion 54. A free rotating sleeve 58 is mounted above the mandrel 56 and a top bearing 60 is positioned in the sleeve 58, between the mandrel portion 56 and the sleeve 58. A lower bearing 62 is positioned adjacent a lower edge 64 of the sleeve 58, between the sleeve 58 and the mandrel portion 56.

Similarly to the sleeve 30, the sleeve 58 carries a plurality of bristles 66 positioned in a plurality of non-axial rows, extending in a spiral fashion and winding from the top of the sleeve 58 to the bottom 64 of the sleeve 58. Similarly to the bristles 32, the bristles 66 can be arranged along a helical path of constant pitch and diameter from one end of the sleeve to the other. The helical path formed by the bristles 66 in the tool 50 forms a left hand helical path allowing the sleeve 58 to rotate counter-clockwise when positioned in the casing. When the left hand tool 50 is run in conjunction with the right hand tool 10, a counter rotating effect is achieved when drifting in and out of the hole. As a result, a self-rotating sweeping action is created that dislodges the debris in the inner casing crevices, including the crevice created between adjoining casing segments.

The bearing assemblies 42 and 44 are housed in both ends of the sleeves 30 and 58. They also slide on the mandrels 16 and 56. When putting the tool brush assembly together, the bearing assembly is inserted into the brush sleeves at both ends and the brush sleeve is then placed over the mandrel and coupled with the tool joint component 18. Torque is then applied to the mandrel and to the connector sub 18 to complete the assembly. The bearing assemblies 42 and 44 allow the brush sleeves 30 and 58 to rotate with ease when tripping in and out of the well bore.

It is possible to incorporate the brush tools 10 and 50 in the same string with magnetic well cleaning tools. When such magnets are installed above and below the brush tools 10 and 50 or between them, loosened ferrous material can be recovered and disposed of at the surface. The circulation of fluids in the casing facilitates removal of the debris. As a result, a clean wellbore environment is created allowing for trouble free installation of any necessary production equipment. The sleeves 30 and 58 rotate when the tools 10 and 50 are lowered into the wellbore. The brush bristles 32 and 66 make contact with the internal wall of the casing. The downward force generated by the rotation of the sleeves 30 and 58 generates sufficient rotation to scrub the internal wall of the casing. When the sleeves 30 and 58 are run together, the counter-rotating effect is achieved when the tools 10 and 50 are lowered and retrieved from the well bore. While it is extremely difficult to impart rotation on a casing brush when using conventional tool, the tools 10 and 50 of the present invention provide the desired rotational movement due to the particular arrangement of the bristle rows and free rotation of the sleeves 30 and 58. The result is a rotationally cleaned casing, cleared of the accumulated or existing debris that is run in and out of the casing without the need to apply the rotation force from the surface.

The casing brush tool of the present invention allows to significantly reduce the time of casing cleaning and facilitates circulation of fluid through the casing. With conventional brushes, it is a problem to pump about two barrels a minute to lift debris from the wellbore. The tool brush of the present invention allows pumping of up to 10 barrels a minute while removing the debris from the casing and allowing full production of the wellbore.

Many changes and modifications can be made into the design of the present invention without departing from the spirit thereof. I therefore pray that my rights to the present invention be limited only by the scope of the appended claims.

I claim:

1. A casing brush tool for cleaning the walls of a well casing, comprising:

a first brush body and a second brush body;

a first sleeve mounted in a free rotational relationship about said first brush body, said first sleeve carrying a plurality of non-axial rows of bristles for contacting the walls of the well casing;

a second sleeve mounted in a free rotational relationship about said second brush body, said sleeve carrying a plurality of non-axial rows of bristles disposed about said second sleeve, wherein said bristles of the second sleeve, when contacting the wall of the well casing, cause rotation of the second sleeve in a second predetermined direction about a central axis of the second brush body; and wherein said second sleeve rotates in the second predetermined direction opposite to the predetermined direction of rotation of said first sleeve.

2. A casing brush tool for cleaning the walls of a well casing, comprising:

a first brush body and a second brush body;

a first sleeve mounted in a free rotational relationship about said first brush body, said first sleeve carrying a plurality of non-axial rows of bristles for contacting the walls of the well casing;

a second sleeve mounted in a free rotational relationship about said second brush body, said sleeve carrying a plurality a non-axial rows of bristles disposed about said second sleeve, wherein said bristles of the second sleeve; and a bearing means mounted between said second brush body and said second sleeve to facilitate rotation of said second sleeve.

3. A casing brush tool assembly for cleaning the walls of a well casing, comprising:

a first brush body and a second brush body;

a first sleeve mounted in a free rotational relationship over said first brush body, said first sleeve carrying a plurality of bristles secured in helical rows about an exterior of said first sleeve;

a second sleeve mounted in a free rotational relationship over said second brush body, said second sleeve carrying a plurality of bristles secured in helical rows about an exterior of said second sleeve, said second sleeve rows extending in a direction opposite to a direction of helical rows of the first sleeve such that said first sleeve and said second sleeve rotate in opposite direction when said bristles contact the walls of the well casing; and a means for facilitating rotation of said first sleeve and said second sleeve about respective brush bodies, said rotation facilitating means comprising a bearing mounted between the first sleeve and the second sleeve and the respective brush bodies.

4. A method of cleaning the walls of a well casing, comprising the steps of:

providing a first elongated casing brush tool having a first brush body;

providing a first sleeve mounted for a free axial rotation about said first brush body, said first sleeve carrying a plurality of bristles secured in non-axial rows, said rows of bristles being positioned in a helical path about exterior of the first sleeve;

providing a second brush tool having a second brush body and a second sleeve mounted for a free axial rotation about said second brush body, said second sleeve carrying a plurality of bristles secured in helical rows about a body of the second sleeve and winding in a direction opposite to a direction of bristle rows of said first casing brush tool;

securing the second casing brush tool end to end to said first casing brush tool; and lowering said first brush tool and the second brush tool into the well casing, while causing the bristles to contact the walls of the well casing, while applying a downward force on said first casing brush tool to thereby cause rotation of respective said first sleeve and said second sleeve in opposite directions and to thereby dislodge by the bristles, extraneous material adhering to the walls.

5. A method of cleaning the walls of a well casing, comprising the steps of:

providing at least one elongated casing brush tool having a first brush body, a first sleeve mounted for a free axial rotation about said first brush body, said first sleeve carrying a plurality of bristles secured in non-axial rows;

providing a bearing means mounted between said at least one brush body and said at least one sleeve so as to facilitate axial rotation of said at least one sleeve about said at least one brush body; and lowering said at least one casing brush tool into the well casing, while causing the bristles to contact the walls of the well casing; applying a downward force on said at least one casing brush tool, thereby casing rotation of said first sleeve and dislodging by the bristles, of extraneous material adhering to the walls.

6. A method of cleaning the walls of a well casing, comprising the steps of:

providing a first elongated casing brush tool having a first brush body, a first sleeve mounted for a free axial rotation about said first brush body, said first sleeve carrying a plurality of bristles secured in non-axial rows;

providing a second brush tool having a second brush body and a second sleeve mounted for a free axial rotation about said second brush body, said second sleeve carrying a plurality of bristles secured in helical rows about a body of the second sleeve and winding in a direction opposite to a direction of bristle rows of said first casing brush tool;

providing a bearing means mounted between said second brush body and said second sleeve so as to facilitate axial rotation of said second sleeve about said second brush body; and lowering said first casing brush tool and said second brush tool into the well casing, while causing the bristles to contact the walls of the well casing; applying a downward force on said first casing brush tool, thereby casing rotation of said first sleeve and said second sleeve and dislodging by the bristles, of extraneous material adhering to the walls.

* * * * *